US010519940B2

(12) United States Patent
Brown et al.

(10) Patent No.: US 10,519,940 B2
(45) Date of Patent: Dec. 31, 2019

(54) HYDRAULIC DRIVE SYSTEM FOR A LINEARLY ACTUATED HYDRAULIC PISTON PUMP

(71) Applicant: Caterpillar Inc., Peoria, IL (US)

(72) Inventors: Aaron M. Brown, Peoria, IL (US); Alan R. Stockner, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 200 days.

(21) Appl. No.: 15/490,947

(22) Filed: Apr. 19, 2017

(65) Prior Publication Data

US 2018/0306173 A1 Oct. 25, 2018

(51) Int. Cl.

*F04B 9/105* (2006.01)
*F04B 15/08* (2006.01)
*F04B 23/06* (2006.01)

(52) U.S. Cl.

CPC ..... *F04B 9/1056* (2013.01); *F04B 15/08* (2013.01); *F04B 23/06* (2013.01); *F04B 2015/081* (2013.01)

(58) Field of Classification Search

CPC ..... F04B 15/08; F04B 9/1056; F04B 23/06; F04B 2015/081

See application file for complete search history.

(56) References Cited

U.S. PATENT DOCUMENTS 2,846,187 A * 8/1958 Sublett ..... E01B 29/26 254/18
2,973,629 A 3/1961 Lady
4,013,385 A 3/1977 Peterson
4,342,543 A 8/1982 Allen et al.
5,263,828 A 11/1993 Schwing et al.
5,615,705 A * 4/1997 Cho ..... E02F 9/2217 137/596.2
5,634,779 A 6/1997 Eysymontt
5,832,808 A * 11/1998 Ishizaki ..... F15B 11/024 91/447
5,884,675 A 3/1999 Krasnov
8,523,533 B1 * 9/2013 Best ..... F04B 1/32 417/46
8,615,705 B2 * 12/2013 Oneda ..... G06F 17/217 715/200

(Continued)

FOREIGN PATENT DOCUMENTS

CN 103133434 6/2013
GB 734295 7/1955

*Primary Examiner* — Charles G Freay
*Assistant Examiner* — Lilya Pekarskaya
(74) *Attorney, Agent, or Firm* — Harrity & Harrity LLP

(57) ABSTRACT

A linearly actuated hydraulic piston pump is provided. The pump includes a piston disposed between a first section and a second section of a piston chamber. The pump also includes a control valve having a valve body defining a valve chamber therein. The control valve also includes an inlet port, a first port, a regeneration port, a second port, and a spool. The spool in a first spool position fluidly couples a pressurized fluid source to the first section via the inlet port and the first port, and fluidly couples an accumulator to the second section via the regeneration port and the second port. The spool in the second spool position fluidly couples the first section to a drain via the first port and a drain port, and fluidly couples the second section to the pressurized fluid source via the inlet port and the second port.

14 Claims, 6 Drawing Sheets

(56) References Cited

U.S. PATENT DOCUMENTS

| | | | | |
|---|---|---|---|---|
| 9,273,664 | B2 * | 3/2016 | Scheffel | F03B 15/00 |
| 2014/0154099 | A1 * | 6/2014 | Sivaramakrishnan | F04B 9/113 417/53 |

* cited by examiner

HYDRAULIC DRIVE SYSTEM FOR A LINEARLY ACTUATED HYDRAULIC PISTON PUMP

TECHNICAL FIELD

The present disclosure relates to a hydraulic drive system for a linearly actuated hydraulic piston pump. More particularly, the present disclosure relates to the hydraulic drive system for controlling an operation of the linearly actuated hydraulic piston pump.

BACKGROUND

Generally, a pump used for pumping a cryogenic fluid, such as liquefied natural gas (LNG), may include a hydraulically actuated piston pump. The hydraulically actuated piston pump may be hydraulically driven during a pumping stroke and may be spring driven during a return stroke of the pump. In such a situation, the spring may wear making it difficult to achieve consistent spring parameters over a service life of the spring.

For example, consistency in a spring force, spring stiffness, a travel distance of the spring, and/or other parameters of the spring may alter over the service life in turn affecting one or more pumping parameters of the pump. Also, for the cryogenic fluid, such as LNG, a movement of the piston of the pump may have to be controlled accurately during an end of the pumping stroke and/or a beginning of the return stroke in order to limit vaporization of the LNG during the pumping cycle.

In some situations, a hydraulically driven piston may be employed. However, in such situations, an efficiency of the pump may be decreased as a volume of a hydraulic fluid required during the return stroke in order to retract the piston may be same as a volume of the hydraulic fluid required to extend the piston during the pumping stroke. Also, a pressure of the hydraulic fluid may have to be controlled accurately during the pumping stroke and/or the return stroke in order to limit vaporization of the LNG during the pumping cycle.

U.S. Pat. No. 5,263,828 describes a two-cylinder thick matter pump having a hydro-controlled storage piston which is filled during thick matter feed with feed cylinders and evacuated by the hydro-controlled storage piston into a feed pipe between the strokes of feed pistons to reduce a pressure drop and an undelivered amount in the feed pipe. The hydro-control of the storage piston is served by a working piston to be acted upon hydraulically on both sides, that is controlled with the feed cylinders and whose limits of travel, with the limits of travel of the storage piston, are fixed on a storage driving cylinder when the storage driving cylinder is fully evacuated and is filled.

SUMMARY OF THE DISCLOSURE

In an aspect of the present disclosure, a linearly actuated hydraulic piston pump includes a pumping chamber having a pumping element located inside the pumping chamber. The linearly actuated hydraulic piston pump includes a piston chamber having a piston located between a first section and a second section of the piston chamber. The piston is coupled to the pumping element. The linearly actuated hydraulic piston pump includes a control valve including a valve body. The valve body defines a valve chamber. The linearly actuated hydraulic piston pump includes an inlet port fluidly coupled to the valve chamber, and a pressurized fluid source.

The linearly actuated hydraulic piston pump includes a first port fluidly coupled to the valve chamber, and the first section of the piston chamber. The linearly actuated hydraulic piston pump includes a regeneration port fluidly coupled to an accumulator, the valve chamber, and the second section of the piston chamber at a first location. The linearly actuated hydraulic piston pump includes a second port fluidly coupled to the valve chamber, and the second section of the piston chamber at a second location. The linearly actuated hydraulic piston pump further includes a spool adapted to move between a first spool position and a second spool position within the valve chamber. The spool fluidly couples the pressurized fluid source to the first section of the piston chamber via the inlet port and the first port in the first spool position. Further, the spool fluidly couples the accumulator to the second section of the piston chamber via the regeneration port and the second port in the first spool position to drive the piston in a first piston direction. The spool fluidly couples the first section of the piston chamber to a drain via the first port and a drain port in the second spool position. Further, the spool fluidly couples the second section of the piston chamber to the pressurized fluid source via the inlet port and the second port in the second spool position to drive the piston in a second piston direction.

In another aspect of the present disclosure, a hydraulic drive system for a linearly actuated hydraulic piston pump is provided. The linearly actuated hydraulic piston pump includes a piston chamber having a first section and a second section. The hydraulic drive system includes a control valve having a valve body. The valve body defines a valve chamber. The hydraulic drive system includes an inlet port fluidly coupled to the valve chamber and a pressurized fluid source. The hydraulic drive system includes a first port fluidly coupled to the valve chamber and the first section of the piston chamber. The hydraulic drive system includes a regeneration port fluidly coupled to an accumulator, the valve chamber and the second section of the piston chamber at a first location. The hydraulic drive system includes a second port fluidly coupled to the valve chamber and the second section of the piston chamber at a second location. The hydraulic drive system further includes a spool configured to move between a first spool position and a second spool position within the valve chamber. The spool in the first spool position fluidly couples the pressurized fluid source to the first section of the piston chamber via the inlet port and the first port, and fluidly couples the accumulator to the second section of the piston chamber via the regeneration port and the second port to drive the piston in a first piston direction. The spool in the second spool position fluidly couples the first section of the piston chamber to a drain via the first port and a drain port, and fluidly couples the second section of the piston chamber to the pressurized fluid source via the inlet port and the second port to drive the piston in a second piston direction.

In yet another aspect of the present disclosure, a method of operating a linearly actuated hydraulic piston pump is provided. The linearly actuated hydraulic piston pump includes a piston chamber having a first section and a second section. The linearly actuated hydraulic piston pump includes a control valve fluidly coupled to the first section and the second section of the piston chamber. The method includes providing a source of a pressurized fluid to the control valve. The method includes moving a spool of the control valve into a first spool position which directs the pressurized fluid into the first section of the piston chamber to drive the piston along a first piston direction. The method further includes moving the spool of the control valve into a second spool position which directs the pressurized fluid into the second section of the piston chamber to drive the piston along a second piston direction.

Other features and aspects of this disclosure will be apparent from the following description and the accompanying drawings.

DETAILED DESCRIPTION

Figure 1:
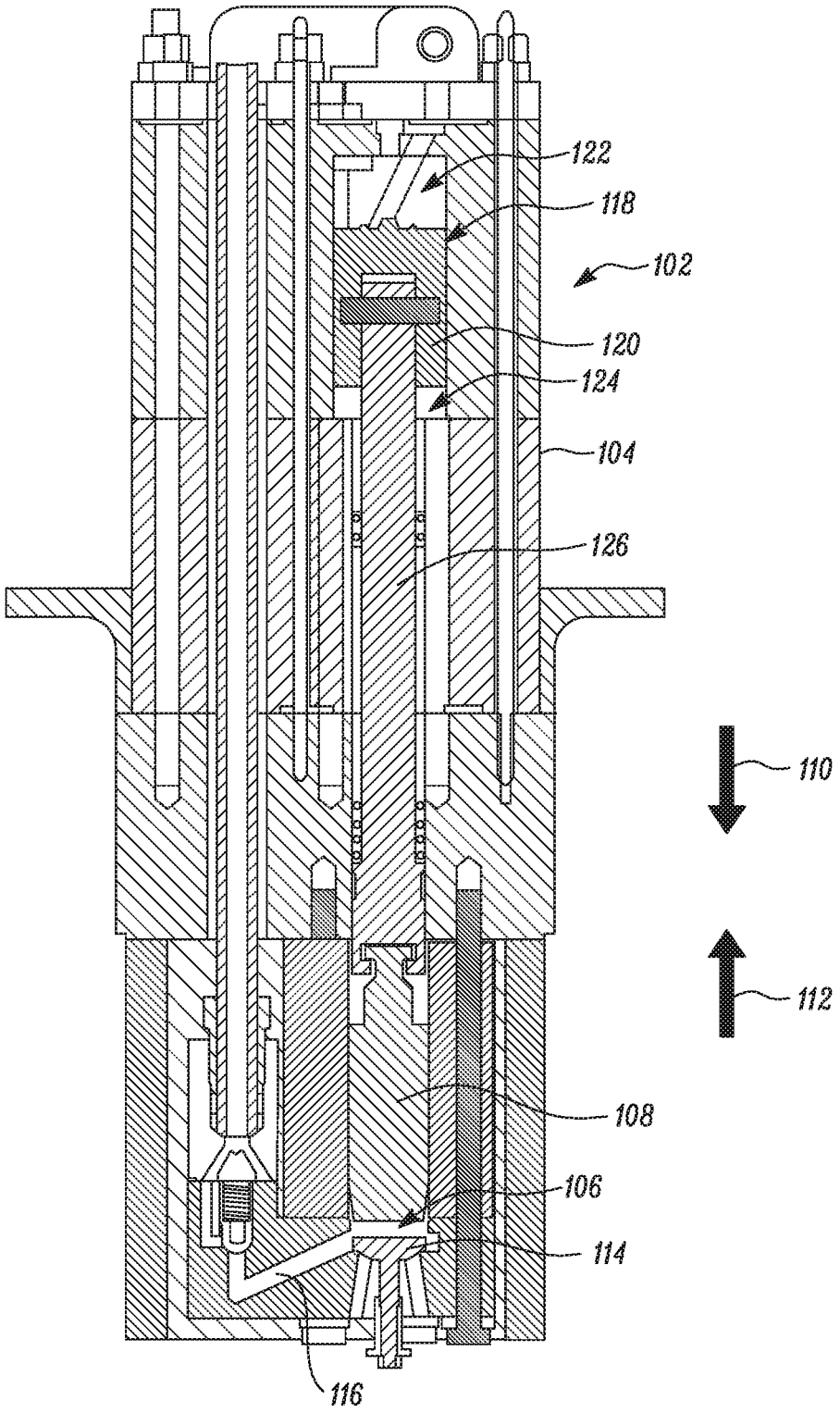
FIG. 1 is a cross-sectional view of an exemplary linearly actuated hydraulic piston pump, according to one embodiment of the present disclosure.

Wherever possible, the same reference numbers will be used throughout the drawings to refer to the same or the like parts. Referring to FIG. 1, a cross sectional view of an exemplary linearly actuated hydraulic piston pump 102 is illustrated. The linearly actuated hydraulic piston pump 102 will be hereinafter interchangeably referred to as the "pump 102". The pump 102 may be a submersible type of a multi element pump employed for pumping of a liquid, such as LNG.

In one embodiment, the pump 102 may be a fuel pump associated with an engine (not shown) operating on LNG fuel. The pump 102 may be installed within a LNG fuel tank (not shown) associated with the engine and may be further provided in fluid communication with one or more fuel injectors of the engine. In other embodiments, the pump 102 may be associated with a storage tank (not shown), such as at a LNG terminal, on a LNG carrier, and so on. The pump 102 may be associated with any industry such as, but not limited to, automobiles, heavy machinery, transportation, oil and gas etc. It should be contemplated that the applications of the pump 102 described herein are merely exemplary and the pump 102 may be employed for various other applications including applications outside cryogenic environment.

The pump 102 includes a body 104 which may enclose various components of the pump 102 therein. The pump 102 includes a pumping chamber 106 provided within the body 104. The pumping chamber 106 includes a pumping element 108 inside the pumping chamber 106 configured to translate within the pumping chamber 106 along a first piston direction 110 during a pumping stroke of the pump 102, and a second piston direction 112 during a return stroke of the pump 102. The pump 102 includes an intake port 114 and an outlet port 116 provided in fluid communication with the pumping chamber 106.

The pump 102 includes a piston chamber 118 provided within the body 104. The piston chamber 118 includes a piston 120 inside the piston chamber 118 which may reciprocate inside the piston chamber 118 between a first section 122 and a second section 124. The piston 120 is coupled to the pumping element 108 through a push rod 126. The piston 120 may undergo a reciprocating motion between the first section 122 and the second section 124. While undergoing the reciprocating motion, the piston 120 travels in the first piston direction 110 and the second piston direction 112. A pumping stroke and a return stroke are defined based on the direction of travel of the piston 120 inside the piston chamber 118. The piston 120 travels along the first piston direction 110 during the pumping stroke and along the second piston direction 112 during the return stroke. As the pumping element 108 is coupled to the piston 120 through the push rod 126, the pumping element 108 translates within the pumping chamber 106 as a result of the reciprocating motion of the piston 120.

Figure 2:
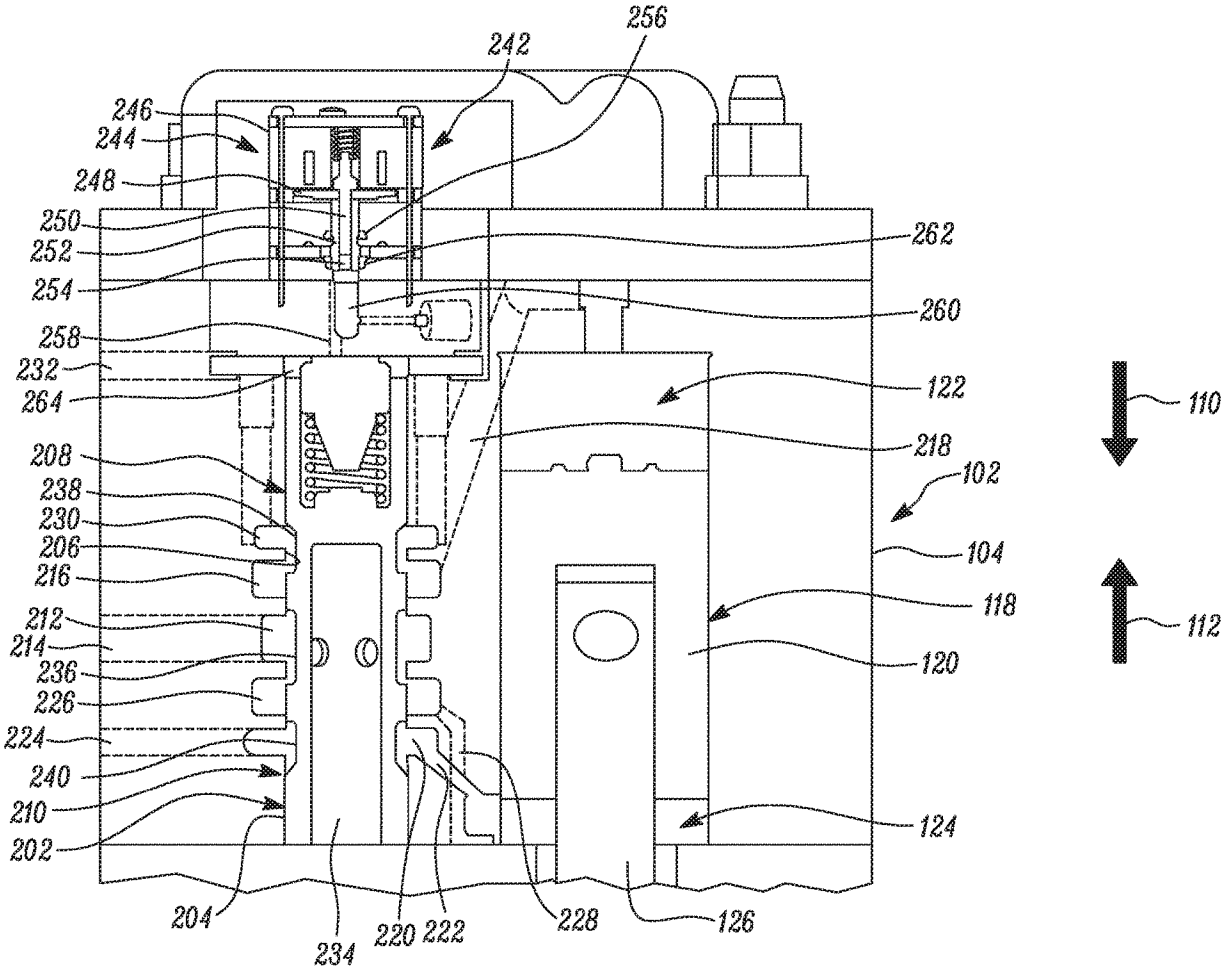
FIG. 2 is another partial cross-sectional view of the linearly actuated hydraulic piston pump of FIG. 1 showing a control valve thereof, according to one embodiment of the present disclosure.
Figure 3:
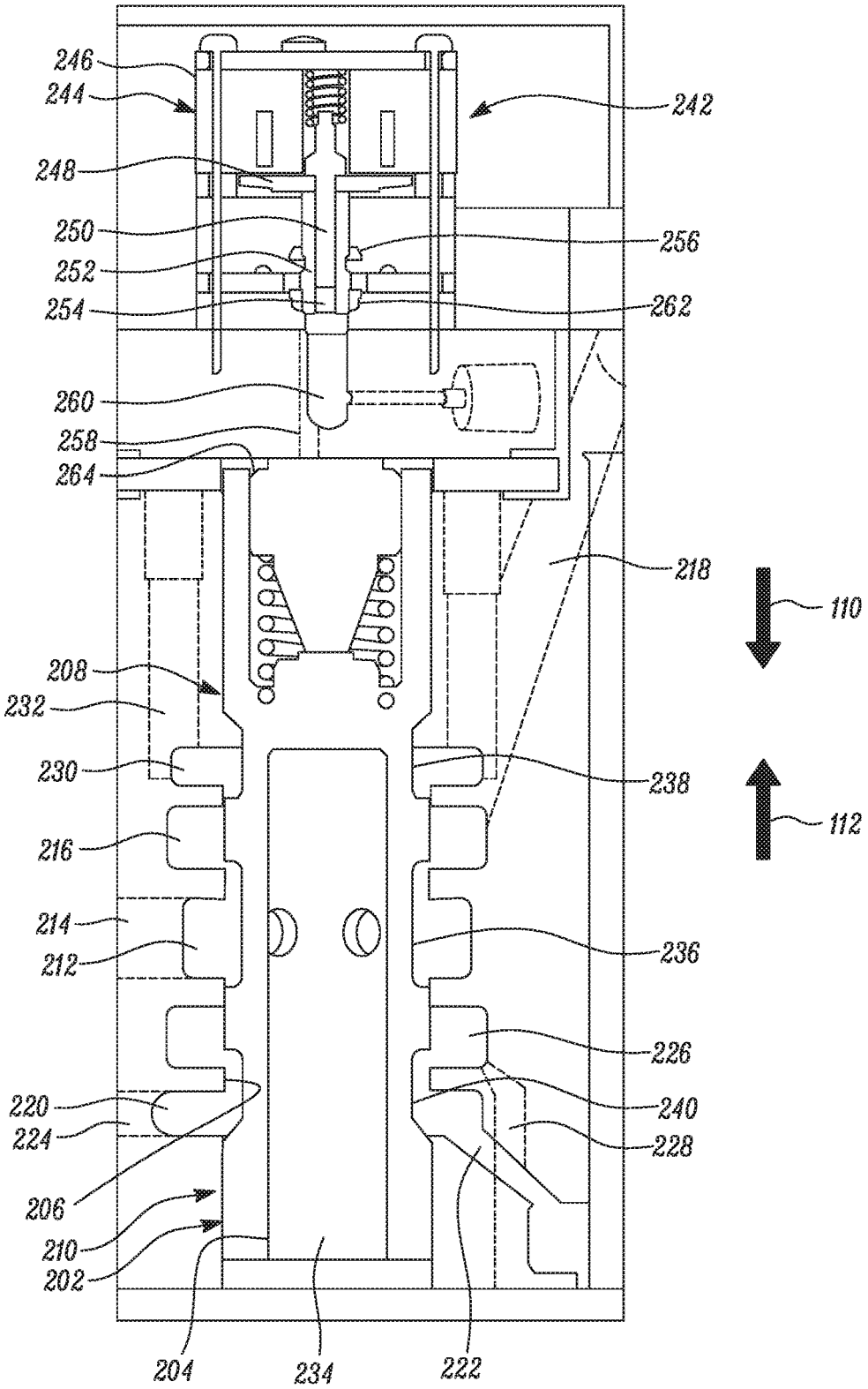
FIG. 3 is a cross-sectional view of the control valve of FIG. 2 in a first position thereof, according to one embodiment of the present disclosure.
Figure 4:
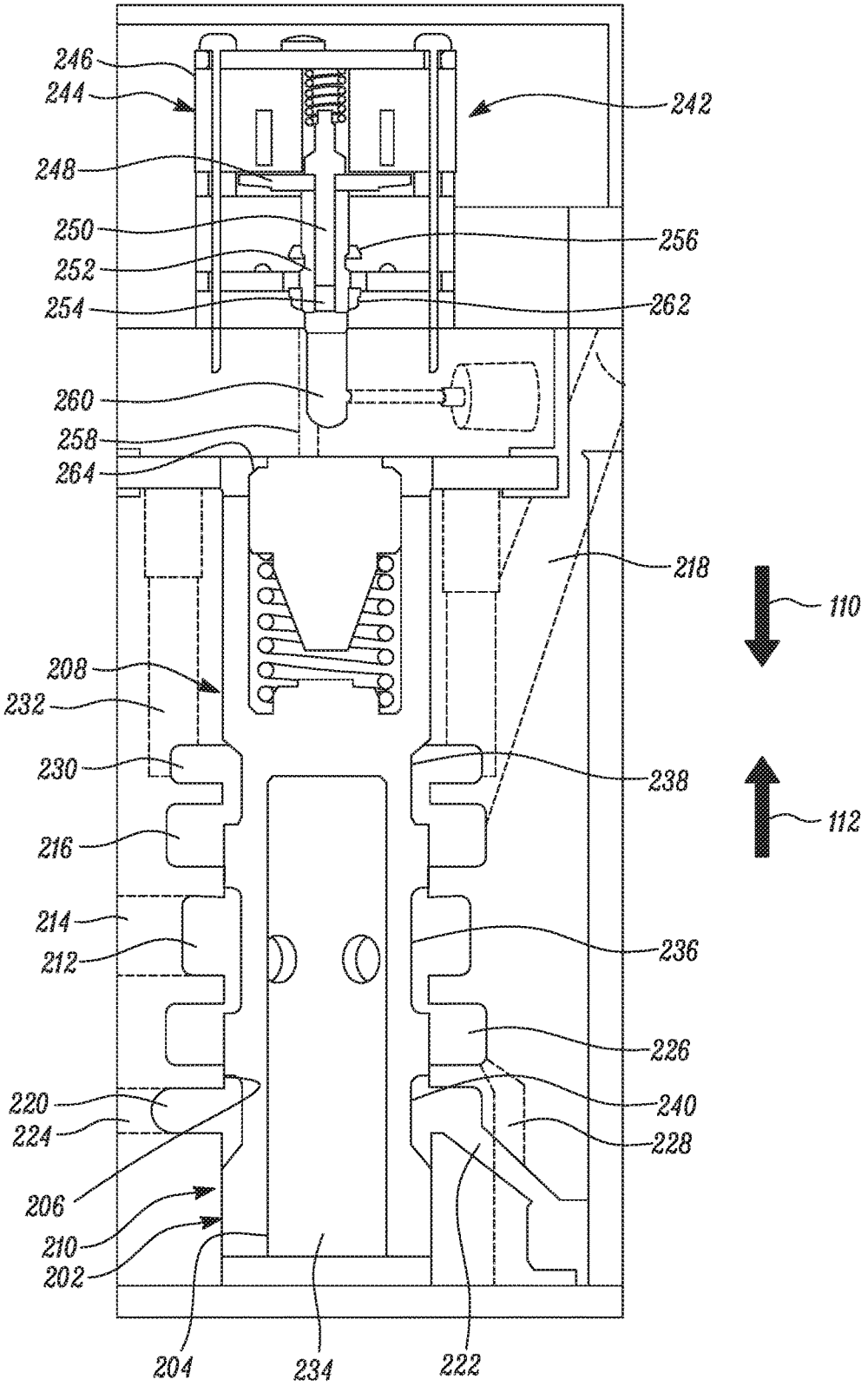
FIG. 4 is a cross-sectional view of the control valve of FIG. 2 in a second position thereof, according to one embodiment of the present disclosure.
Figure 5:
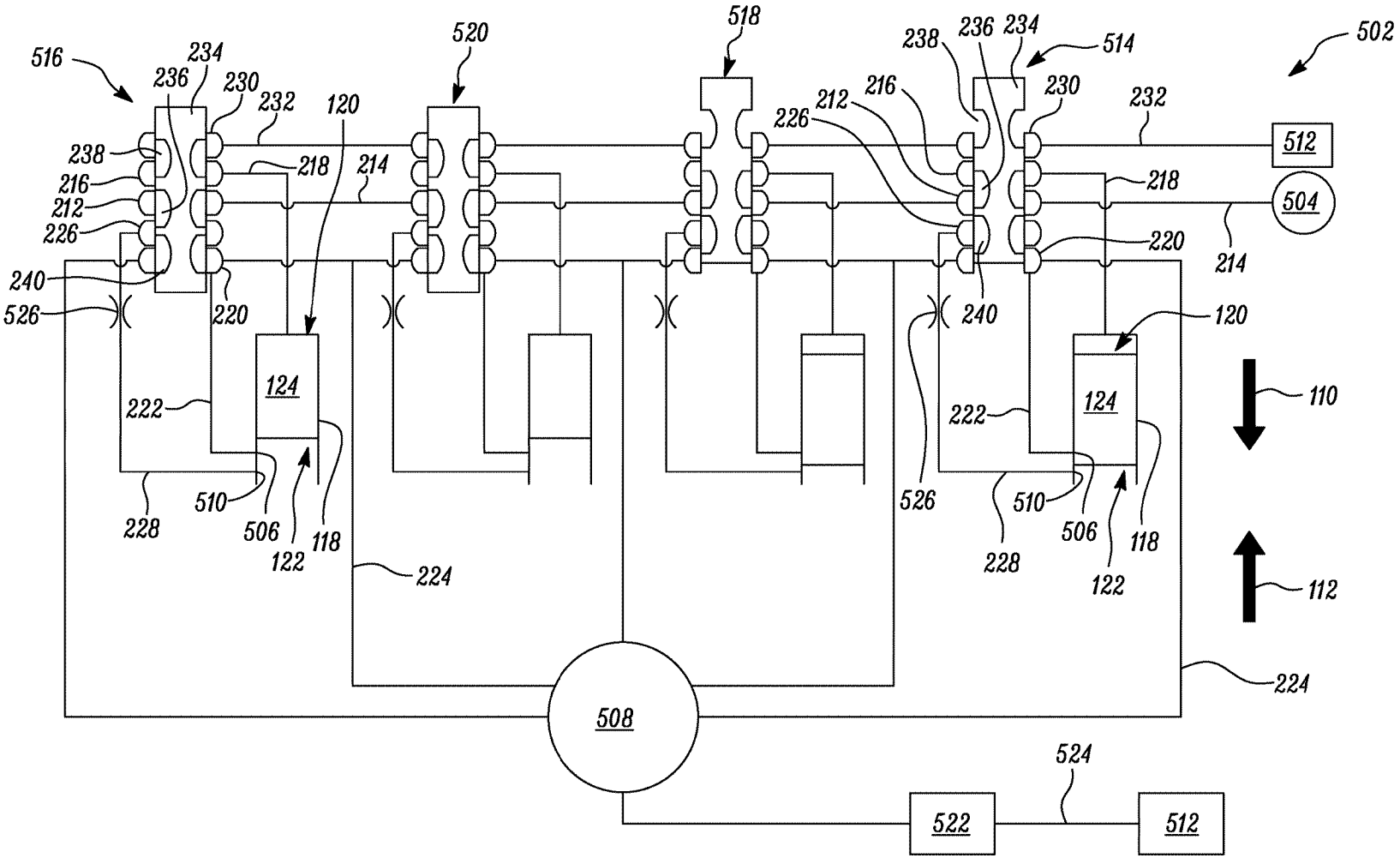
FIG. 5 is a schematic representation of a hydraulic drive system for the linearly actuated hydraulic piston pump of FIG. 1, according to one embodiment of the present disclosure.

Referring to FIGS. 2, 3, and 4, the pump 102 includes a control valve 202 that forms part of a hydraulic drive system 502 (shown in FIG. 5). The hydraulic drive system 502 will be explained in detail in forthcoming description with reference to FIGS. 5 & 6. The control valve 202 includes a valve body 204 defining a valve chamber 206 therein. The valve chamber 206 has a first end 208 and a second end 210. The control valve 202 includes an inlet port 212 fluidly coupled to the valve chamber 206. The inlet port 212 receives pressurized fluid from a pressurized fluid source 504 (shown in FIG. 5) through an inlet passage 214 and supplies the pressurized fluid to the valve chamber 206. The pressurized fluid source 504 may be any pump, such as a piston pump, a centrifugal pump etc. which may provide pressurized fluid to the inlet port 212 as per application requirements.

The control valve 202 includes a first port 216 fluidly coupled to the valve chamber 206. The first port 216 is provided towards the first end 208 of the valve chamber 206 as compared to the inlet port 212. A first passage 218 fluidly couples the first port 216 to the first section 122 of the piston chamber 118. The control valve 202 includes a regeneration port 220 fluidly coupled to the valve chamber 206. The regeneration port 220 is provided towards the second end 210 of the valve chamber 206 as compared to the inlet port 212. A regeneration passage 222 fluidly couples the regeneration port 220 to the second section 124 of the piston chamber 118. The regeneration port 220 is coupled to the second section 124 of the piston chamber 118 at a first location 506 (shown in FIG. 5) on the second section 124 of the piston chamber 118. Further, an auxiliary passage 224 fluidly couples an accumulator 508 (shown in FIG. 5) of the hydraulic drive system 502 to the regeneration port 220.

The control valve 202 further includes a second port 226 fluidly coupled with the valve chamber 206. The second port 226 is provided towards the second end 210 of the valve chamber 206 as compared to the inlet port 212, and towards the first end 208 of the valve chamber 206 as compared to the regeneration port 220. A second passage 228 fluidly couples the second port 226 to the second section 124 of the piston chamber 118 at a second location 510 (shown in FIG. 5) on the second section 124 of the piston chamber 118. The second location 510 is provided vertically spaced apart from the first location 506 such that the first location 506 is at a higher level as compared to the second location 510 when measured along the first piston direction 110.

The control valve 202 includes a drain port 230 fluidly coupled to the valve chamber 206. A drain passage 232 fluidly couples the drain port 230 to a drain 512 (shown in FIG. 5). Further, the control valve 202 includes a spool 234 provided within the valve chamber 206. The spool 234 may reciprocate within the valve chamber 206 between a first spool position and a second spool position. The spool 234 includes a first groove 236, a second groove 238, and a third groove 240 provided on the spool 234 in a spaced apart manner.

The reciprocating movement of the spool 234 may be actuated through an actuator 242. The actuator 242 may be any type of an actuator which may actuate the movement of the spool 234 within the valve chamber 206 as per application requirements. For example, the actuator 242 may be an electromechanical actuator, a piezoelectric actuator or any other type of actuator which may suit the need of the present disclosure. In the illustrated embodiment, the actuator 242 is an electromechanical type of actuator.

The actuator 242 includes a solenoid 244 having a coil 246, an armature 248, and a pin 250. Based on an energized or a de-energized state of the solenoid 244, the pin 250 reciprocates within a pin guide 252 forming a hollow bore 254. The hollow bore 254 is fluidly isolated from a hydraulic oil supply passage 256, a spool valve supply outlet 258, and a drain outlet 260. More specifically, during operation, based on the energized or de-energized state of the solenoid 244, the pin 250 moves within the pin guide 252 between an activation position and a drain position.

In the drain position, an actuator valve 262 opens as the armature 248 moves upwards which fluidly couples the spool valve supply outlet 258 with the drain outlet 260. The drain outlet 260 is connected to a control chamber 264 and drains the hydraulic fluid above the spool 234, causing the spool 234 to move upwards in the first spool position by hydraulic force with respect to the control chamber 264. Similarly, when the pin 250 is in the activation position, the spool valve supply outlet 258 is fluidly coupled with the hydraulic oil supply passage 256, which supplies the hydraulic fluid above the spool 234 in the control chamber 264, causing the spool 234 to extend with respect to the control chamber 264 in the second spool position. Accordingly, the solenoid 244 controls the movement of the spool 234 between the first spool position and the second spool position. It should be contemplated that the spool 234 may be actuated using any other method as well, other than the one described herein, without limiting the scope of the present disclosure.

Referring to FIG. 3, the control valve 202 is illustrated with the spool 234 in the first spool position. When the spool 234 is in the first spool position, the inlet port 212 is fluidly coupled to the first port 216 through the first groove 236. Consequently, the pressurized fluid source 504 gets fluidly coupled to the first section 122 of the piston chamber 118 through the inlet port 212 and the first port 216. The pressurized fluid supplied by the pressurized fluid source 504 through the inlet passage 214 passes through the inlet port 212, the first port 216 and reaches the first section 122 of the piston chamber 118. Also, the second port 226 is fluidly coupled to the regeneration port 220 through the third groove 240. Consequently, the accumulator 508 gets fluidly coupled to the second section 124 of the piston chamber 118 through the regeneration port 220 and the second port 226.

Referring to FIG. 4, the control valve 202 is illustrated with the spool 234 in the second spool position. When the spool 234 is in the second spool position, the first port 216 is fluidly coupled to the drain port 230 through the first groove 236. Consequently, the first section 122 of the piston chamber 118 gets fluidly coupled to the drain 512 through the first port 216 and the drain port 230. Also, the inlet port 212 is fluidly coupled to the second port 226 through the first groove 236. Consequently, the second section 124 of the piston chamber 118 gets fluidly coupled to the pressurized fluid source 504 through the inlet port 212 and the second port 226. The pressurized fluid supplied by the pressurized fluid source 504 through the inlet passage 214 passes through the inlet port 212, the second port 226 and reaches the second section 124 of the piston chamber 118.

Referring to FIG. 5, the hydraulic drive system 502 is schematically illustrated. The hydraulic drive system 502 includes a first control valve 514, a second control valve 516, a third control valve 518, and a fourth control valve 520 associated with a first pump (not shown), a second pump (not shown), a third pump (not shown), and a fourth pump (not shown) respectively. Each of the first control valve 514, the second control valve 516, the third control valve 518, and the fourth control valve 520 is structurally similar to the control valve 202, and include all the parts and components as the control valve 202. Each of the first pump, the second pump, the third pump, and the fourth pump is similar to the linearly actuated hydraulic piston pump 102.

The hydraulic drive system 502 includes the accumulator 508. The accumulator 508 is fluidly coupled to the regeneration port 220 of each of the first control valve 514, the second control valve 516, the third control valve 518, and the fourth control valve 520 through the auxiliary passage 224. The accumulator 508 may be any pressure regulated hydraulic accumulator which may suit the need of the present disclosure. The accumulator 508 is fluidly coupled with a regulator 522. The regulator 522 may be any pressure controlled valve which may control fluid pressure within the accumulator 508 as a function of a stroking speed of the piston 120 during travel of the piston 120 in at least one of the first piston direction 110 and the second piston direction 112.

The regulator 522 may relieve excess pressure within the accumulator 508 beyond a predefined threshold. The predefined threshold may be such that the pressure within the accumulator 508 may be controlled in order to control the stroking speed of the piston 120 during the return stroke in the second piston direction 112 to limit vaporization of the LNG as the LNG may be drawn into the pumping chamber 106. Also, the predefined threshold may be defined such that the pressure within the accumulator 508 may be controlled in order to control the stroking speed of the piston 120 during the pumping stroke in the first piston direction 110 to achieve a desired pumping frequency or delivery requirement. In case of an excess pressure condition, excess fluid within the accumulator 508 may be directed through the regulator 522 to the drain 512 via an auxiliary drain passage 524.

The hydraulic drive system 502 further includes an orifice 526 provided between the second port 226 and the second section 124 of the piston chamber 118 of each of the first valve 514, the second valve 516, the third valve 518, and the fourth valve 520. The orifice 526 is fluidly coupled to the second port 226 and the second section 124 of the piston 120. The orifice 526 may provide a restriction to flow of the pressurized fluid between the second port 226 and the second section 124 of each of the first valve 514, the second valve 516, the third valve 518, and the fourth valve 520.

With reference to the first valve 514, the spool 234 is illustrated in the first spool position. In the first spool position of the spool 234, the pressurized fluid supplied by the pressurized fluid source 504 is directed through the inlet passage 214, the inlet port 212, the first groove 236, the first port 216, and the first passage 218 further into the first section 122 of the piston chamber 118. Due to an increase in pressure within the first section 122, the piston 120 travels in the first piston direction 110 towards the second section 124. Simultaneously, as the piston 120 travels in the first piston direction 110 up to the first location 506, a portion of the fluid present within the second section 124 is directed through the regeneration passage 222, the regeneration port 220, and the auxiliary passage 224 to the accumulator 508.

As the piston 120 travels further in the first piston direction 110 past the first location 506, the piston 120 in the first spool position of the spool 234 blocks fluid communication between the second section 124 of the piston chamber 118 and the regeneration passage 222. As the piston 120 travels further in the first piston direction 110 past the first location 506 up to the second location 510, a remaining portion of the fluid present within the second section 124 is directed through the second passage 228, the orifice 526, the second port 226, the third groove 240, the regeneration port 220, and the auxiliary passage 224 into the accumulator 508. The orifice 526 restricts the flow of the remaining portion of the fluid from the second section 124 to the accumulator 508, in turn dampening the travel of the piston 120 from the first location 506 towards the second location 510 in the first piston direction 110.

With reference to the second valve 516, the spool 234 is illustrated in the second spool position. In the second spool position of the spool 234, the pressurized fluid is directed through the inlet passage 214, the inlet port 212, the first groove 236, the second port 226, the second passage 228, and the orifice 526 further into the second section 124 of the piston chamber 118. Due to an increase in pressure within the second section 124, the piston 120 travels in the second piston direction 112 towards the first section 122. Also, the orifice 526 restricts the flow of the pressurized fluid from the second port 226 to the second section 124 in turn dampening the travel of the piston 120 from the second location 510 towards the first location 506 in the second piston direction 112.

As the piston 120 travels further in the second piston direction 112 past the first location 506, the piston 120 in the second spool position of the spool 234 allows fluid communication between the second section 124 of the piston chamber 118 and the regeneration passage 222. Accordingly, as the piston 120 travels further in the second piston direction 112 past the first location 506, the fluid present in the accumulator 508 is directed through the auxiliary passage 224, the regeneration port 220, and the regeneration passage 222 into the second section 124. Simultaneously, as the piston 120 travels in the second piston direction 112 towards the first section 122, the fluid present within the first section 122 is directed through the first passage 218, the first port 216, the second groove 238, and the drain port 230 to the drain 512. More specifically, in the second spool position of the spool 234 and/or during the travel of the piston 120 in the second piston direction 112, the fluid present in the first section 122 of the piston chamber 118 is drained through the drain port 230.

It should be contemplated that working of the first valve 514 and the second valve 516 described herein is similarly applicable to the third valve 518, and the fourth valve 520 respectively. Also, in other embodiments, the hydraulic drive system 502 may include a single or multiple valves without limiting the scope of the present disclosure.

INDUSTRIAL APPLICABILITY

Figure 6:
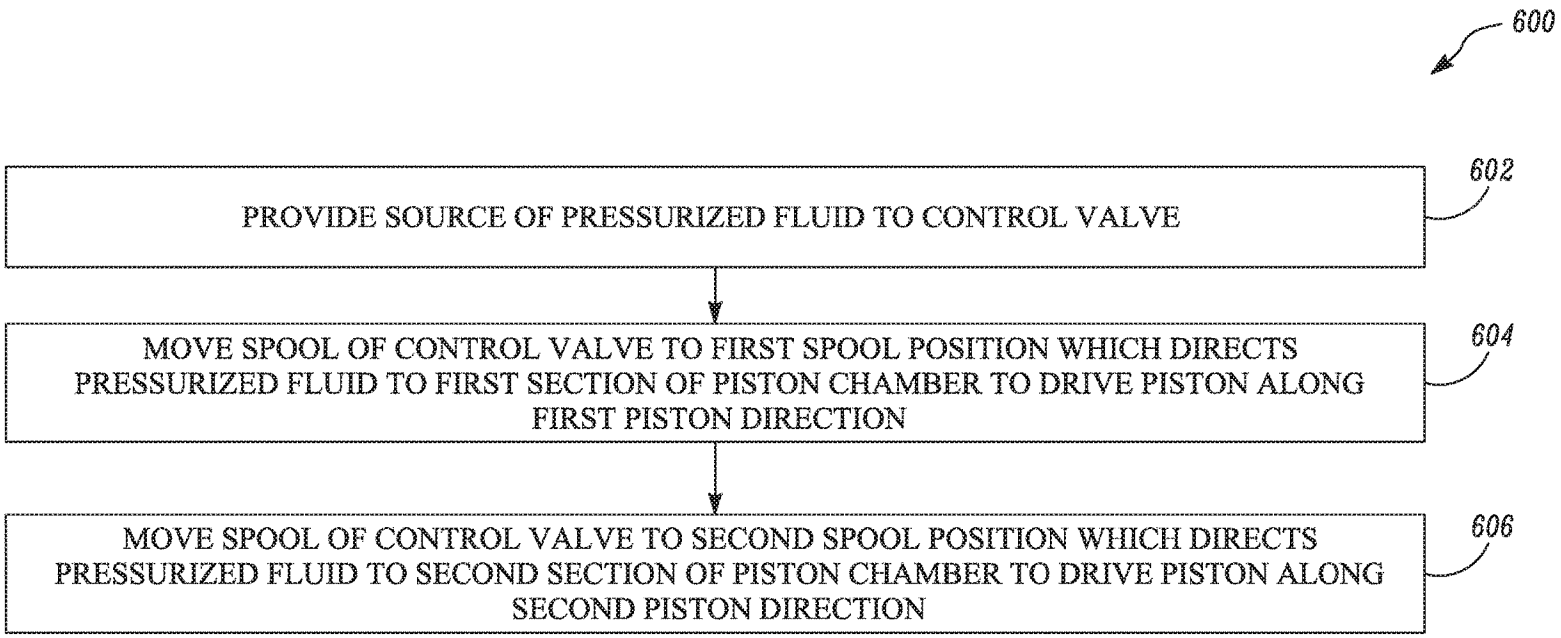
FIG. 6 is a flowchart illustrating a method of working of the hydraulic drive system of FIG. 5, according to one embodiment of the present disclosure.

The present disclosure provides a method 600 of operating the linearly actuated hydraulic piston pump 102 having the hydraulic drive system 502. FIG. 6 illustrates the method 600 with the help of a flow chart. The method 600 at 602 provides pressurized fluid to the control valve 202 through the pressurized fluid source 504. The pressurized fluid source 504 provides the pressurized fluid to the inlet port 212 of the control valve 202 through the inlet passage 214.

The method 600 at 604 moves the spool 234 of the control valve 202 into the first spool position within the valve chamber 206. Consequently, the pressurized fluid is directed into the first section 122 of the piston chamber 118 to drive the piston 120 along the first piston direction 110. The pressurized fluid is directed from the pressurized fluid source 504 through the inlet passage 214, the inlet port 212, the first groove 236, the first port 216, and the first passage 218 into the first section 122 of the piston chamber 118.

Simultaneously, during travel of the piston 120 along the first piston direction 110, the fluid is directed from the second section 124 of the piston chamber 118 into the accumulator 508. A portion of the fluid is directed from the second section 124 through the regeneration passage 222, the regeneration port 220, and the auxiliary passage 224 into the accumulator 508 as the piston 120 travels in the first piston direction 110 up to the first location 506. Further, remaining fluid is directed from the second section 124 through the second passage 228, the orifice 526, the second port 226, the third groove 240, the regeneration port 220, and the auxiliary passage 224 into the accumulator 508 as the piston 120 travels in the first piston direction 110 past the first location 506 up to the second location 510. Further, the orifice 526 dampens the travel of the piston 120 in the first piston direction 110 from the first location 506 up to the second location 510.

The method 600 at step 606 moves the spool 234 of the control valve 202 into the second spool position within the valve chamber 206. Consequently, the pressurized fluid is directed into the second section 124 of the piston chamber 118 to drive the piston 120 along the second piston direction 112. The pressurized fluid is directed from the pressurized fluid source 504 through the inlet passage 214, the inlet port 212, the first groove 236, the second port 226, the orifice 526, and the second passage 228 into the second section 124 as the piston 120 travels in the second piston direction 112 from the second location 510 up to the first location 506. Further, as the piston 120 travels in the second piston direction 112 past the first location 506, the fluid from the accumulator 508 is directed through the auxiliary passage 224, the regeneration port 220, and the regeneration passage 222 into the second section 124. Further, the orifice 526 dampens the travel of the piston 120 in the second piston direction 112 from the second location 510 up to the first location 506.

Simultaneously, during travel of the piston 120 along the second piston direction 112, the fluid is directed from the first section 122 of the piston chamber 118 into the drain 512. The fluid is drained from the first section 122 through the first passage 218, the first port 216, the second groove 238, the drain port 230, and the drain passage 232 into the drain 512 as the piston 120 travels in the second piston direction 112.

The hydraulic drive system 502 provides a simple, effective, and cost efficient method of controlling the pumping stroke and the return stroke of the pump 102 without use of complex electronic control circuitry and methods. The hydraulic drive system 502 improves efficiency and pressure control problems associated with the linearly actuated hydraulic piston pump 102 by capturing the fluid, such as the hydraulic oil, present under the piston 120 in the second section 124 during the pumping stroke. The captured fluid is directed and stored in the accumulator 508 regulated to a desired pressure. The captured fluid is then directed to the second section 124 of other valves within the hydraulic drive system 502 in order to return the respective pistons to their respective starting points for the respective pumping strokes. Thus, the efficiency of the pumping cycles is increased and the pressure within the piston chamber 118 is regulated in order to limit vaporization of LNG during the pumping cycle.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A linearly actuated hydraulic piston pump comprising:

a pumping chamber including a pumping element disposed therein;

a piston chamber including a piston disposed between a first section and a second section of the piston chamber, the piston being coupled to the pumping element;

a control valve including a valve body, the valve body defining a valve chamber;

an inlet port in fluid communication with the valve chamber and a pressurized fluid source;

a first port in fluid communication with the valve chamber and the first section of the piston chamber;

a regeneration port in fluid communication with an accumulator, the valve chamber, and the second section of the piston chamber at a first location;

a second port in fluid communication with the valve chamber and the second section of the piston chamber at a second location;

an orifice provided between the second port and the second section of the piston chamber, the orifice being configured to provide a restriction to a flow of pressurized fluid between the second port and the second section of the piston chamber; and a spool configured to move between a first spool position and a second spool position within the valve chamber, wherein the spool, in the first spool position, fluidly couples the pressurized fluid source to the first section of the piston chamber via the inlet port and the first port, and fluidly couples the accumulator to the second section of the piston chamber via the regeneration port and the second port to drive the piston in a first piston direction; and wherein the spool, in the second spool position, fluidly couples the first section of the piston chamber to a drain via the first port and a drain port, and fluidly couples the second section of the piston chamber to the pressurized fluid source via the inlet port and the second port to drive the piston in a second piston direction.

2. The linearly actuated hydraulic piston pump of claim 1, further comprising:

a regeneration passage in fluid communication with the second section of the piston chamber and the regeneration port.

3. The linearly actuated hydraulic piston pump of claim 2, wherein the piston in a second piston position allows fluid communication between the second section of the piston chamber and the regeneration passage, and the piston in a first piston position blocks fluid communication between the second section of the piston chamber and the regeneration passage.

4. The linearly actuated hydraulic piston pump of claim 1, wherein the first piston direction is a pumping stroke of the linearly actuated hydraulic piston pump.

5. The linearly actuated hydraulic piston pump of claim 1, wherein the second piston direction is a return stroke of the linearly actuated hydraulic piston pump.

6. The linearly actuated hydraulic piston pump of claim 1, wherein the accumulator is in fluid communication with a regulator, the regulator being configured to control fluid pressure in the accumulator as a function of a stroking speed of the piston during travel of the piston in at least one of the first piston direction and the second piston direction.

7. The linearly actuated hydraulic piston pump of claim wherein the linearly actuated hydraulic piston pump is a multi-element pump.

8. A hydraulic drive system for a linearly actuated hydraulic piston pump, the linearly actuated hydraulic piston pump including a piston chamber, the piston chamber including a first section and a second section, and the hydraulic drive system comprising:

a control valve including a valve body, the valve body defining a valve chamber;

an inlet port in fluid communication with the valve chamber and a pressurized fluid source;

a first port in fluid communication with the valve chamber and the first section of the piston chamber;

a regeneration port in fluid communication with an accumulator, the valve chamber, and the second section of the piston chamber at a first location;

a second port in fluid communication with the valve chamber and the second section of the piston chamber at a second location;

an orifice provided between the second port and the second section of the piston chamber, the orifice being configured to provide a restriction to a flow of pressurized fluid between the second port and the second section of the piston chamber; and a spool configured to move between a first spool position and a second spool position within the valve chamber, wherein the spool, in the first spool position, fluidly couples the pressurized fluid source to the first section of the piston chamber via the inlet port and the first port, and fluidly couples the accumulator to the second section of the piston chamber via the regeneration port and the second port to drive the piston in a first piston direction; and wherein the spool, in the second spool position, fluidly couples the first section of the piston chamber to a drain via the first port and a drain port, and fluidly couples the second section of the piston chamber to the pressurized fluid source via the inlet port and the second port to drive the piston in a second piston direction.

9. The hydraulic drive system of claim 8, further comprising:

a regeneration passage in fluid communication with the second section of the piston chamber and the regeneration port.

10. The hydraulic drive system of claim 9, wherein the piston in a second piston position allows fluid communication between the second section of the piston chamber and the regeneration passage, and the piston in a first piston position blocks fluid communication between the second section of the piston chamber and the regeneration passage.

11. The hydraulic drive system of claim 8, wherein the first piston direction is a pumping stroke of the linearly actuated hydraulic piston pump.

12. The hydraulic drive system of claim 8, wherein the second piston direction is a return stroke of the linearly actuated hydraulic piston pump.

13. The hydraulic drive system of claim 8, wherein the accumulator is in fluid communication with a regulator, the regulator being configured to control fluid pressure in the accumulator as a function of a stroking speed of the piston during travel of the piston in at least one of the first direction and the second direction.

14. The hydraulic drive system of claim 8, wherein the linearly actuated hydraulic piston pump is a multi-element pump.

* * * * *